US007222610B2

(12) United States Patent
Okazono et al.

(10) Patent No.: US 7,222,610 B2
(45) Date of Patent: May 29, 2007

(54) FUEL FEED APPARATUS HAVING SMALL SIZED STRUCTURE

(75) Inventors: Tetsuro Okazono, Okazaki (JP); Takashi Koba, Nishikamo-gun (JP); Yoshio Ebihara, Kariya (JP); Mikio Torii, Hekinan (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/214,744

(22) Filed: Aug. 31, 2005

(65) Prior Publication Data

US 2007/0044771 A1 Mar. 1, 2007

(51) Int. Cl.
*F02M 37/04* (2006.01)
*F02M 37/10* (2006.01)

(52) U.S. Cl. ..... 123/509

(58) Field of Classification Search ..... 123/509, 123/510, 514; 137/571, 565.01; 210/473, 210/477

See application file for complete search history.

(56) References Cited

U.S. PATENT DOCUMENTS 4,591,319 A 5/1986 Takahashi et al.
5,649,514 A 7/1997 Okada et al.
5,778,926 A 7/1998 Tanaka et al.
5,782,223 A 7/1998 Yamashita et al.
5,785,032 A 7/1998 Yamashita et al.
5,900,148 A 5/1999 Izutani et al.
5,992,394 A 11/1999 Mukaidani et al.
6,293,770 B1 9/2001 Matsumoto et al.
6,328,063 B1 * 12/2001 Tistchenko ..... 137/565.22
6,453,870 B1 * 9/2002 Koller et al. ..... 123/198 E
6,551,509 B2 * 4/2003 Appleton ..... 210/416.4
7,007,678 B2 * 3/2006 Schultz et al. ..... 123/509

(Continued)

FOREIGN PATENT DOCUMENTS

JP 9-53536 2/1997

(Continued)

OTHER PUBLICATIONS

Japanese Office Action dated Dec. 22, 2006 issued in corresponding JP Application No. 2003-149079 with English translation.

(Continued)

*Primary Examiner*—Mahmoud Gimie
(74) *Attorney, Agent, or Firm*—Nixon & Vanderhye PC

(57) ABSTRACT

A lid member is mounted to the fuel tank to cover an opening of the fuel tank. A fuel pump is arranged in the fuel tank to pump fuel in the fuel tank. A module case supports the fuel pump. A pump module includes fuel component protruding from a lateral side of the module case in a projection, which is viewed from a side of the lid member. A supporting member is connected with the lid member and the module case to support the pump module in the fuel tank. The lid member supports the pump module via the supporting member. The module case includes a connecting portion that connects with the supporting member. The connecting portion protrudes from the module case to the lateral side of the module case. The connecting portion is arranged in an imaginary circle that passes through outer peripheries of the module case and the fuel component in the projection. The imaginary circle accommodates the module case and the fuel component in the projection.

15 Claims, 3 Drawing Sheets

U.S. PATENT DOCUMENTS

| | | | | |
|---|---|---|---|---|
| 2004/0112819 | A1* | 6/2004 | Ebihara et al. | 210/232 |
| 2005/0166974 | A1* | 8/2005 | Hashiguchi | 137/571 |
| 2005/0178448 | A1* | 8/2005 | Inoue | 137/571 |

FOREIGN PATENT DOCUMENTS

| | | |
|---|---|---|
| JP | A-09-032679 | 2/1997 |
| JP | A-2003-028017 | 1/2003 |
| WO | WO 01/90563 A1 | 11/2001 |

OTHER PUBLICATIONS

JP Examination Report with English translation dated Sep. 28, 2006.

* cited by examiner

FUEL FEED APPARATUS HAVING SMALL SIZED STRUCTURE

CROSS REFERENCE TO RELATED APPLICATIONS

This application is based on and incorporates herein by reference Japanese Patent Application No. 2003-149079 filed on May 27, 2003.

FIELD OF THE INVENTION

The present invention relates to a fuel feed apparatus that supplies fuel in a fuel tank to the outside of the fuel tank.

BACKGROUND OF THE INVENTION

An in-tank type fuel feed apparatus disclosed in U.S. Pat. No. 5,900,148, U.S. Pat. No. 5,785,032, U.S. Pat. No. 5,782,223, U.S. Pat. No. 5,778,926, and U.S. Pat. No. 5,649,514 (WO9623967A1) is accommodated in a fuel tank to supply fuel in the fuel tank to the outside of the fuel tank. In this structure, a lid of a filter housing of a fuel filter is mounted to the fuel tank, so that the lid covers an opening formed in the fuel tank. The filter housing supports the fuel pump. The filter housing has an inlet pipe that directly connects to a discharge pipe of a fuel pump.

As shown in FIG. 4, a fuel feed apparatus 200 has a conventional structure, in which a discharge port 203 of a fuel pump 202 is connected with a suction port 206 of a filter housing 205 of a fuel filter 204 through a connecting member 208. The fuel pump 202 is supported by the filter housing 205 in the fuel feed apparatus 200, similarly to the structure disclosed in U.S. Pat. No. 5,900,148, U.S. Pat. No. 5,785,032, U.S. Pat. No. 5,782,223, U.S. Pat. No. 5,778,926, and U.S. Pat. No. 5,649,514. A lid 210 covers an opening formed in the fuel tank (not shown). The lid 210 is connected with the filter housing 205 by welding or the like.

However, in the fuel feed apparatus disclosed in U.S. Pat. No. 5,900,148, U.S. Pat. No. 5,785,032, U.S. Pat. No. 5,782,223, U.S. Pat. No. 5,778,926, and U.S. Pat. No. 5,649,514, and in the fuel feed apparatus 200 shown in FIG. 4, a pump module, which includes the fuel pump and the fuel filter, is directly mounted to the fuel tank. Accordingly, when the pump module is used in various fuel tanks, which have depth different from each other, the height of the pump module needs to be changed corresponding to the fuel tanks. As a result, the structure of the filter housing needs to be changed for adapting to the fuel tanks. Specifically, in the fuel feed apparatus shown in FIG. 4, the connecting member 208 needs to be changed corresponding to the fuel tanks. Thus, in this structure, a component constructing the pump module needs to be changed in accordance with the depth of the fuel tank. As a result, commonality of components is not sufficient in this structure.

A fuel feed apparatus may include a supporting member that connects a lid member, which is mounted to a fuel tank to cover an opening formed in the fuel tank, with a module case of a pump module, so that the lid member supports the pump module via the supporting member. In this structure, the distance between the lid member and the pump module can be easily changed by adjusting the length of the supporting member.

In this structure, the fuel feed apparatus can be installed in fuel tanks, which have the depth different from each other, without changing the structure of the pump module, so that the pump module can be commonly used in various fuel tanks. The supporting member is connected with the module case. Specifically, a connecting portion is provided to laterally protrude from the sidewall of the module case, so that the module case is connected with the supporting member via the connecting portion.

However, in this structure, the pump module may be radially jumboized. As a result, it may be difficult to insert the pump module into the fuel tank through the opening formed in the fuel tank. The opening of the fuel tank may be widened, so that the pump module can be easily inserted into the fuel tank through the opening. However, when the diameter of the opening is increased, strength of the fuel tank may decrease, and the sealing area may increase.

SUMMARY OF THE INVENTION

In view of the foregoing and other problems, it is an object of the present invention to produce a fuel feed apparatus, in which commonality of a pump module can be easily enabled, and the pump module can be restricted from being radially jumboized.

According to one aspect of the present invention, a fuel feed apparatus supplies fuel in a fuel tank to an outside of the fuel tank. The fuel feed apparatus includes a lid member, a fuel pump, a module case, a pump module, and a supporting member. The lid member is mounted to the fuel tank. The lid member covers an opening of the fuel tank. The fuel pump is accommodated in the fuel tank. The fuel pump pumps fuel in the fuel tank. The module case supports the fuel pump. The pump module includes at least one fuel component protruding from a lateral side of the module case in a projection, which is viewed from a side of the lid member. The supporting member is connected with the lid member and the module case.

The supporting member supports the pump module in the fuel tank. The lid member supports the pump module via the supporting member. The module case includes a connecting portion that connects with the supporting member. The connecting portion protrudes from the module case to a lateral side of the module case. The connecting portion is accommodated in an imaginary circle that passes through an outer periphery of the module case and an outer periphery of the at least one fuel component in the projection. The imaginary circle accommodates the module case and the at least one fuel component therein in the projection.

The pump module may further include a fuel filter that removes debris contained in fuel discharged from the fuel pump. The module case may accommodate a filter element of the fuel filter as a filter case.

The at least one fuel component may include a level meter. The at least one fuel component may include a pressure regulator.

In the above structure, even when the connecting portion laterally protrudes outwardly from the module case, the pump module is not jumboized in the lateral direction thereof. Thus, the pump module can be inserted into the fuel tank without increasing the diameter of the opening formed in the fuel tank.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS (First Embodiment)

Figure 1:
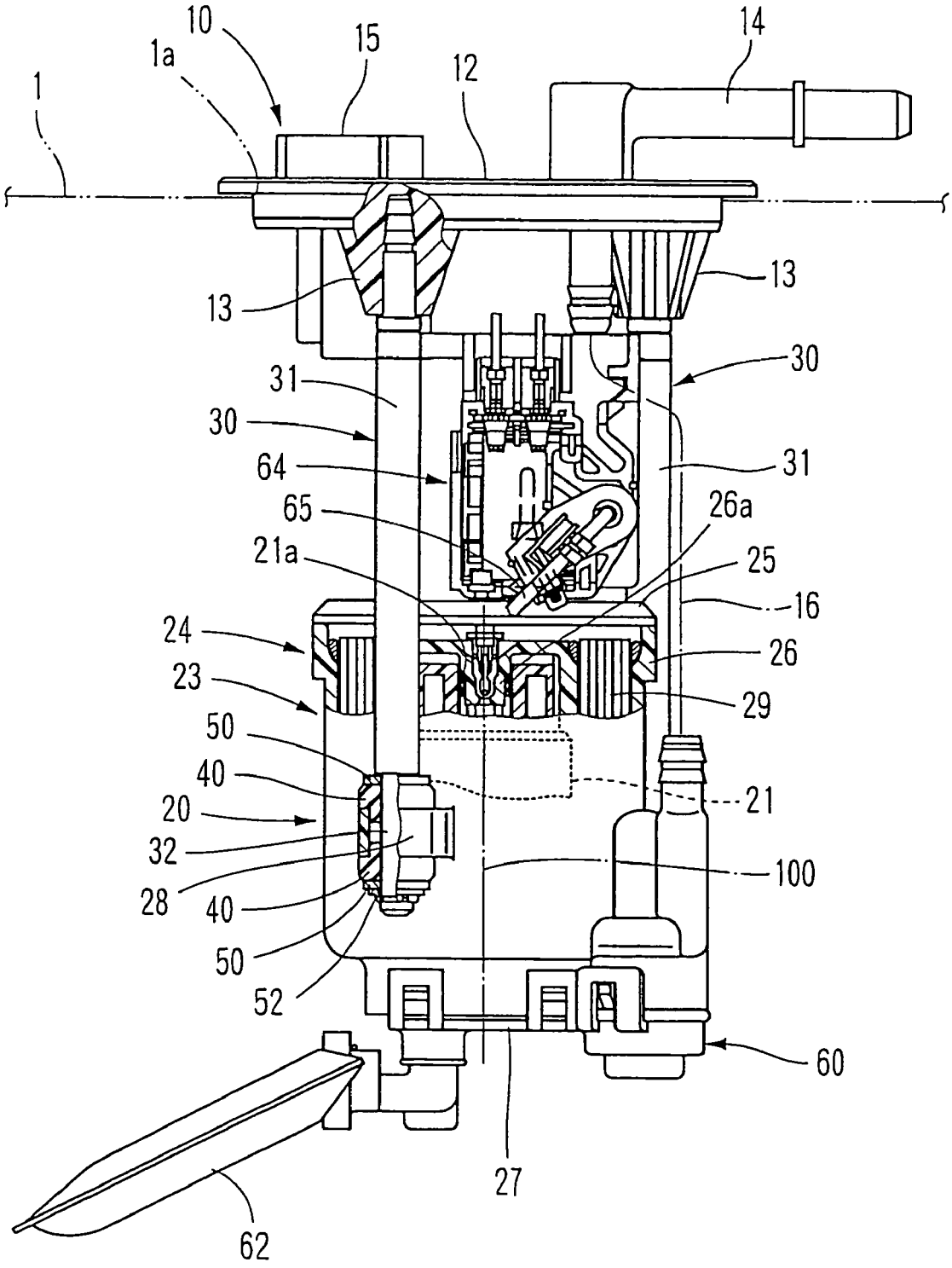
FIG. 1 is a partially cross sectional side view showing a pump module according to a first embodiment of the present invention.

As shown in FIG. 1, a flange 12 is formed in a disc-shape, and is mounted to an upper wall of a fuel tank 1, so that the flange 12 covers an opening formed in the fuel tank 1. The flange 12 serves as a lid member of a fuel feed apparatus 10. Components of the fuel feed apparatus 10 excluding the flange 12 is accommodated in the fuel tank 1. The flange 12 has a fuel discharge pipe 14 and an electric connector 15. Fuel is discharged from a fuel pump 21 of a pump module 20, and the fuel is controlled in pressure by a pressure regulator 60. The fuel passing through the pressure regulator 60 is supplied to the outside of the fuel tank 1 through a bellows pipe 16 and the fuel discharge pipe 14. The electric connector 15 electrically connects with the fuel pump 21 and a level meter 64 via a lead wire (not shown).

The pump module 20 includes the fuel pump 21, a fuel filter 23, the pressure regulator 60, a suction filter 62, the level meter 64, and the like. The pump module 20 is directly accommodated in the fuel tank 1, so that the pump module 20 directly draws fuel in the fuel tank 1. The fuel pump 21 receives a motor (not shown). The motor serves as an electrically driving device. The motor rotates an impeller to generate suction force to draw fuel. The impeller serves as a rotating member.

The fuel filter 23 includes a filter case 24 and a filter element 29. The fuel filter 23 corrects relatively small debris, which is contained in fuel discharged from the fuel pump 21, using the filter element 29. The filter case 24 serves as a module case. The filter case 24 includes a cover 25, a case body 26, and a bracket 27. The filter case 24 accommodates the filter element 29. The case body 26 has an inlet port 26*a* that engages with a fuel outlet port 21*a* of the fuel pump 21.

Figure 2:
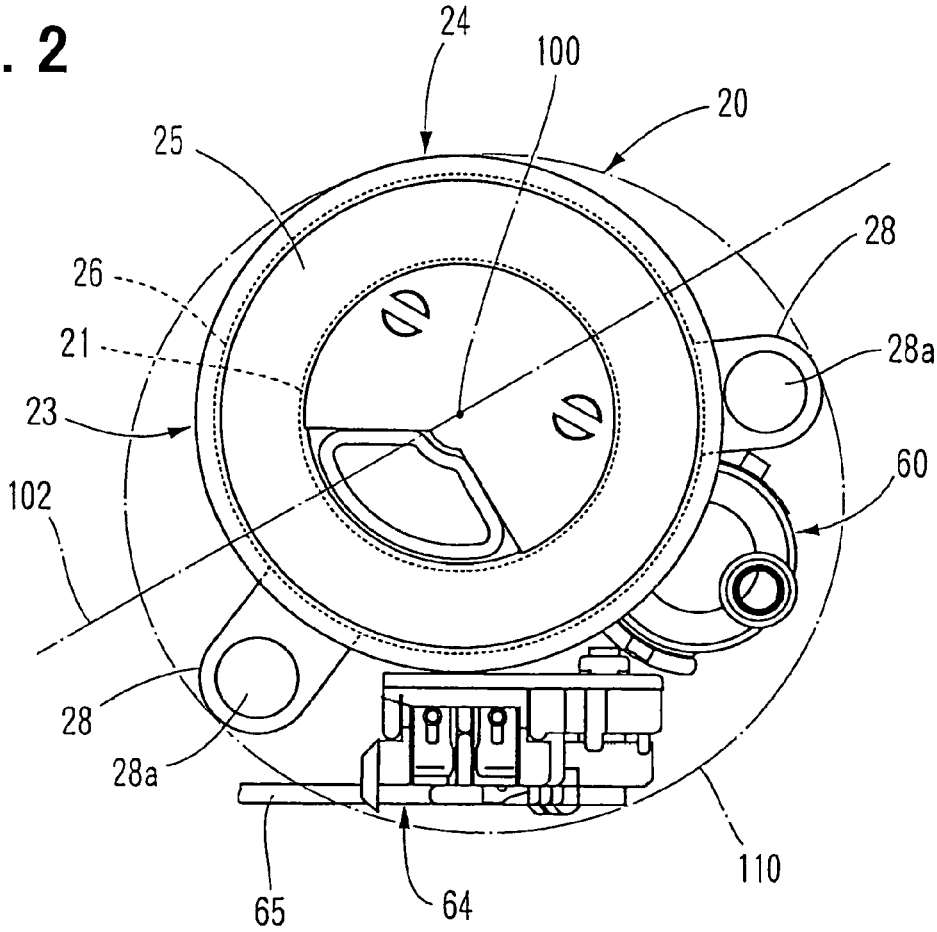
FIG. 2 is a top view showing the pump module according to the first embodiment.

As shown in FIG. 2, the case body 26 has two substantially cylindrical connecting portions 28 that respectively protrude from the lateral side of the filter case 24. Each connecting portion 28 has a through hole 28*a* that penetrates the connecting portion 28 in the axial direction thereof. As referred to FIG. 1, the bracket 27 supports the fuel pump 21.

Each of two shafts 30 is formed of metal or the like to be in a cylindrical bar shape. The shaft 30 serves as a supporting member. The shafts 30 are connected with the flange 12 and the case body 26 of the pump module 20 respectively at two locations. The flange 12 supports the pump module 20 via the two shafts 30. Each shaft 30 has one end that is press-inserted into a press-inserted portion 13 of the flange 12. Each shaft 30 has the other end that is inserted into the through hole 28*a* of the connecting portion 28. The shaft 30 has a large diameter portion 31 and a small diameter portion 32. The diameter of the small diameter portion 32 is smaller than the diameter of the large diameter portion 31. The small diameter portion 32 is inserted into the connecting portion 28.

The connecting portion 28 has openings on both axial ends thereof. Each opening of the connecting portion 28 engages with a vibration insulator 40. That is, the connecting portion 28 engages with the two vibration insulators 40. The shapes of the two vibration insulators 40 are equivalent to each other. Each vibration insulator 40 is formed of an elastic material, which is excellent in oil-resistance, such as acrylonitrile-butadiene rubber (NBR), fluorocarbon rubber, or the like. Each vibration insulator 40 is formed in a cylindrical shape. The vibration insulator 40 is press-inserted into the connecting portion 28, so that the vibration insulator 40 engages with the connecting portion 28. Each vibration insulator 40 is interposed between the connecting portion 28 and a washer 50 on both axial end sides of the connecting portion 28. The small diameter portion 32 of the shaft 30 is press-inserted into the inner periphery of the vibration insulator 40. A clip 52 engages with the small diameter portion 32 of the shaft 30 on the opposite side of the vibration insulator 40 with respect to the washer 50 on the lower side in FIG. 1, so that the clip 52 restricts the shaft 30 from dropping out of the connecting portion 28.

The pressure regulator 60 controls pressure of fuel that is discharged from the fuel pump 21 and is removed of debris through the fuel filter 23. The pressure regulator 60 has a fuel inlet port (not shown) that directly engages with a fuel outlet port of the case body 26.

The suction filter 62 corrects relatively large debris contained in fuel drawn by the fuel pump 21 from the fuel tank 1. The level meter 64 is mounted to the shaft 30. The level meter 64 is provided with an arm 65. The end of the arm 65 is connected with a float (not shown).

Here, FIG. 2 depicts a projection (projected view) when viewed from the side of the flange 12. As referred to FIG. 2, in this embodiment, an imaginary straight line 102 is defined to pass through a center axis 100 of the fuel pump 21. Besides, the pressure regulator 60 and the level meter 64 are arranged on one side with respect to the imaginary straight line 102 in a projection when viewed from the side of the flange 12. The pressure regulator 60 and the level meter 64 are arranged to be in the vicinity of each other on the one side with respect to the imaginary straight line 102 in the projection. That is, the projection is divided by the imaginary straight line 102 into two regions. The pressure regulator 60 and the level meter 64 are arranged in one of the two regions in the projection. The pressure regulator 60 and the level meter 64 are arranged to be in the vicinity of each other in the one of the two regions in the projection.

An imaginary circle 110, which is a perfect circle, passes through both the outer periphery of the filter case 24 and the outer periphery of the level meter 64, which protrudes from the filter case 24 to the lateral side thereof. The imaginary circle 110 accommodates the filter case 24, the pressure regulator 60, and the level meter 64 therein. In this structure, the diameter of the imaginary circle 110 can be reduced to a substantially minimum diameter.

Here, it is conceivable to define an imaginary perfect circle and an imaginary ellipse that respectively pass through the outer periphery of the filter case 24 and the outer periphery of the level meter 64, and respectively accommodate the filter case 24, the pressure regulator 60, and the level meter 64 therein. The diameter of this imaginary perfect circle is shorter than the major axis, i.e., the longer axis of this imaginary ellipse. Therefore, the perfect circle is selected as the imaginary circle 100 in this first embodiment. The connecting portions 28, which respectively connect with the shafts 30, are arranged in the imaginary circle 100. Therefore, as referred to FIG. 2, even when the connecting portions 28 respectively radially protrude outwardly from the filter case 24, the pump module 20 is not jumboized in the radial direction thereof. Thus, the pump module 20 can be inserted into the fuel tank 1 without increasing the diameter of an opening 1*a* of the fuel tank 1.

The suction filter 62, the float mounted to the arm 65 partially protrude laterally from the imaginary circle 110. However, when the pump module 20 is inclined, the pump module 20 can be inserted into the fuel tank 1 from the side of both the suction filter 62 and the float through the opening 1*a*.

Next, definition of components (fuel components) of the fuel feed system is described in detail.

The fuel components are defined such that the fuel components are arranged to protrude from the lateral side of the case (module case, filter case 24) of the pump module 20, and are accommodated in the fuel tank 1 with the fuel pump 21. Besides, most of the fuel components are arranged on the side of the lid member (flange 12) with respect to the lower end of the module case 24. In addition, the locations of the fuel components hardly change in the radial direction with respect to the module case 24.

In the first embodiment, the level meter 64 and the pressure regulator 60 are included in the fuel components. However, in the first embodiment, the bellows pipe 16, the suction filter 62, the arm 65, and the float are not included in the fuel components. The reasons are as follows. The bellows pipe 16 is flexible, so that the radial position of the bellows pipe 16 can be changed with respect to a filter case 24. The suction filter 62 is arranged such that most part of the suction filter 62 is arranged on the opposite side of the flange 12 with respect to the lower end of the filter case 24. The arm 65 connected to the level meter 64 and the float connected to the arm 65 respectively rotate corresponding to the liquid level of fuel, so that the radial positions of the arm 65 and the float change corresponding to the liquid level.

(Second Embodiment)

Figure 3:
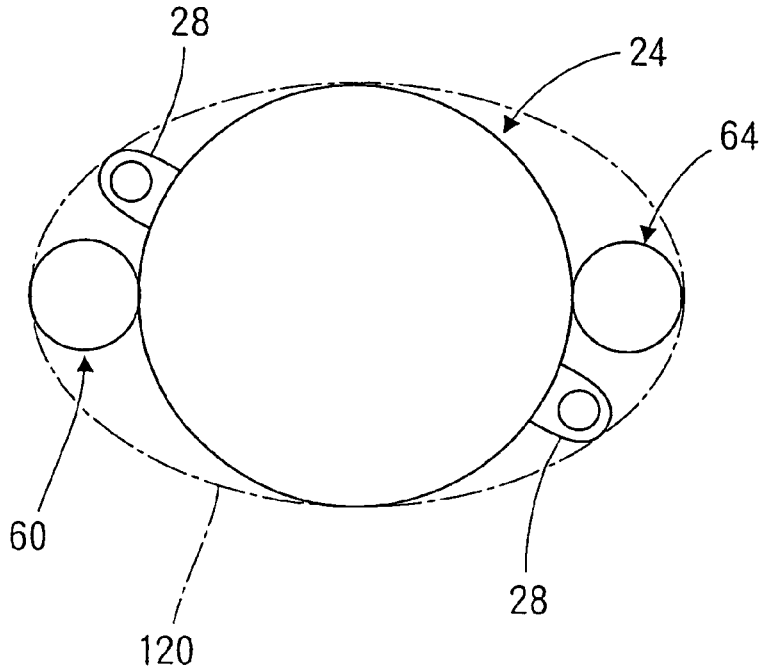
FIG. 3 is a schematic view showing components of a pump module according to a second embodiment of the present invention.
Figure 4:
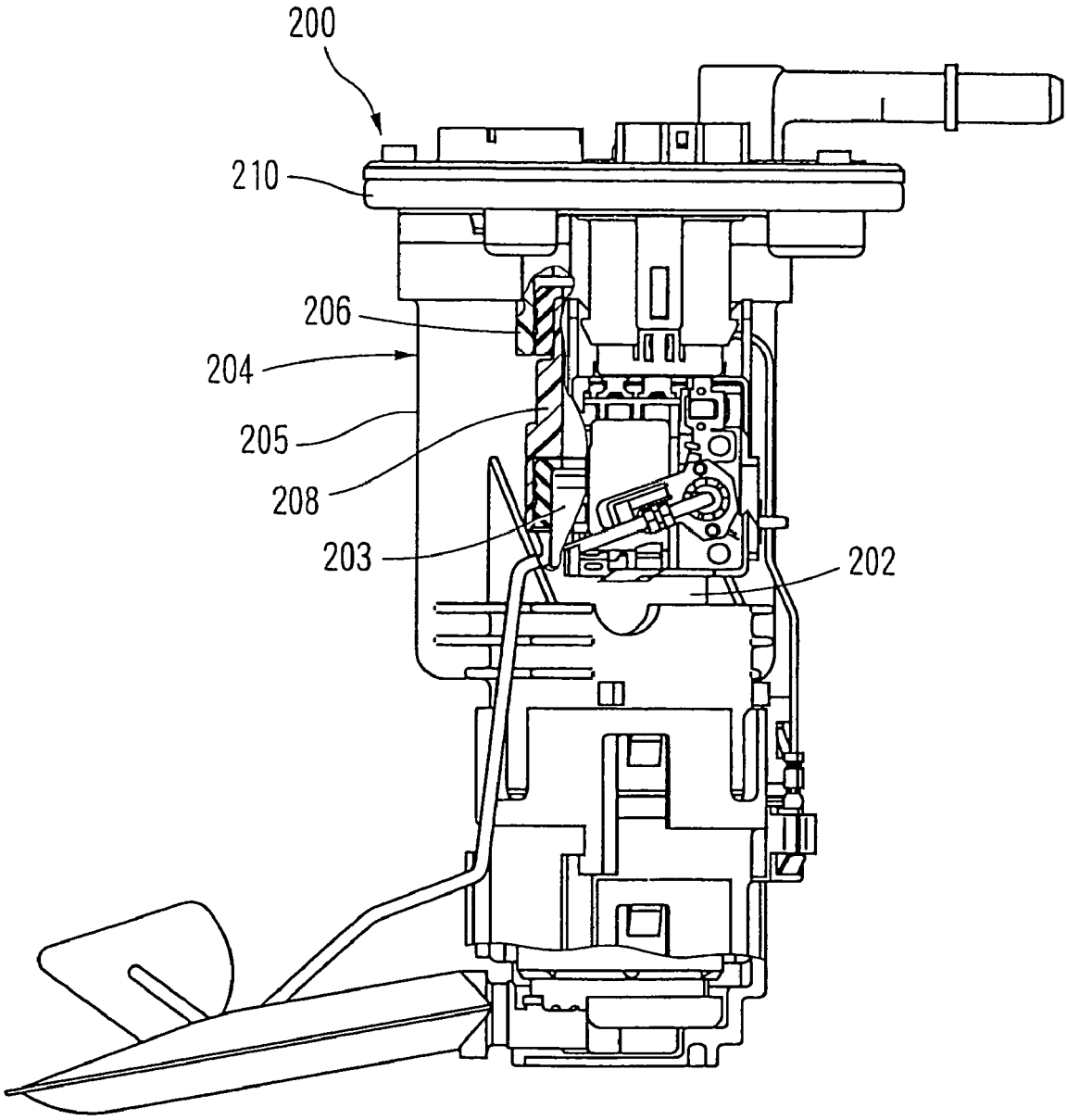
FIG. 4 PRIOR ART
FIG. 4 is a partially cross sectional side view showing a pump module according to a prior art.

FIG. 3 depicts a projection (projected view) showing the pump module 20 from the side of the flange 12. In FIG. 3, the pressure regulator 60 is arranged on a substantially opposite side of the level meter 64 with respect to the filter case 24 in the radial direction of the filter case 24.

An imaginary ellipse 120 passes through the outer periphery of the filter case 24, the outer periphery of the level meter 64, which protrude from the filter case 24 to the lateral side. The imaginary ellipse 120 accommodates the filter case 24, the pressure regulator 60, and the level meter 64 therein. The imaginary ellipse 120 further accommodates the connecting portions 28. Even when the connecting portions 28 are provided to the filter case 24, the body size of the pump module 20 is not jumboized in the radial direction thereof, as referred to FIG. 3.

Here, it is conceivable to define an imaginary perfect circle and an imaginary ellipse that respectively pass through the outer periphery of the filter case 24 and the outer periphery of the level meter 64, and respectively accommodate the filter case 24, the pressure regulator 60, and the level meter 64 therein. The minor axis, i.e., shorter axis of this imaginary ellipse is shorter than the diameter of this imaginary perfect circle. Therefore, the ellipse, i.e., the oval figure is selected as the imaginary circle 120 in this second embodiment.

In the above structures of the embodiments, the shafts 30 respectively connect the flange 12, which is mounted to the fuel tank 1, with the filter case 24 of the pump module 20. The flange 12 supports the pump module 20 via the shafts 30. In these structures, the fuel feed apparatus can be mounted to fuel tanks, which have depth different from each other, by adjusting the length of the shafts 30, without replacing the components of the pump module 20. Therefore, when the fuel feed apparatus is mounted to fuel tanks, which have depth different from each other, the pump module can be commonly used. That is, commonality of the pump module can be easily enabled.

Furthermore, the connecting portions 28 protrude from the sidewall of the filter case 24, so that other components do not interfere the shafts 30 and the connecting portions 28 when the shafts 30 and the connecting portions 28 are connected with each other. Therefore, the shafts 30 can be easily assembled to the connecting portions 28.

In the above embodiments, the connecting portions 28 are arranged in the imaginary circle, which has the smallest diameter, passing through the outer peripheries of the filter case 24 and the components of the fuel feed system and receiving the filter case 24 and the fuel components, in the projection being viewed from the side of the flange 12. Therefore, even when the connecting portions 28 protrude from the lateral side of the filter case 24, the pump module 20 can be restricted from being radially jumboized.

In the above embodiment, one of the perfect circle and the ellipse is selected from the perfect circle and the ellipse defining the imaginary circle, which has the smallest diameter, passing through the outer peripheries of the filter case 24 and the fuel components and receiving the filter case 24 and fuel the components. The one of the perfect circle and the ellipse has the diameter that is smaller than the other one of the perfect circle and the ellipse.

Furthermore, the vibration insulator 40, which is made of an elastic material such as rubber, is provided to the joining portion between each connecting portion 28 and each shaft 30. Thereby, vibration of the pump module 20 arising in the fuel pump 21 and the pressure regulator 60 can be restricted from being transmitted from the fuel pump 21 to the fuel tank 1 via the shaft 30. Therefore, vibration of the pump module 20 can be restricted from causing noise in the fuel tank 1.

In the above embodiments, the pump module includes the fuel filter, and the filter case of the fuel filter also serves as the module case. Therefore, the pump module including the fuel pump and the fuel filter can be small sized.

Here, in a structure, in which the filter case of the fuel filter entirely surrounds the circumferential peripheries of the fuel pump and the fuel components, is apt to protrude to the lateral side of the module case. In addition to this structure, when the connecting portion, which connects with the supporting member (shaft), protrudes from the lateral side of the module case, the pump module may be further jumboized in the radial direction thereof due to arrangement of the connecting portion. However, in the above embodiments, the connecting portions are arranged within the smallest imaginary circle passing through the outer peripheries of the module case and the fuel components and receiving the module case and the fuel components in the projected view from the side of the lid member (flange). Therefore, even when the connecting portion laterally protrudes from the module case, the pump module can be restricted from being radially jumboized.

In the above embodiments, the fuel components are arranged to be in the vicinity of each other on the one side in the projection partitioned with the imaginary straight line that passes through the center axis of the fuel pump. Therefore, the pump module can be radially small sized.

In the above embodiments, the imaginary circle is one of the perfect circle and the ellipse. The fuel tank has the opening, which is in a shape similar to the imaginary circle. When at least one of the fuel components excessively protrude from the module case out of the imaginary circle, the module case cannot be easily inserted into the fuel tank through the opening. Specifically, when the fuel components are not accommodated in the imaginary circle, an imaginary complicated polygonal shape or the like may need to be defined to accommodate the fuel components. In this structure, the module case, which is in a complicated shape, cannot be easily inserted into the fuel tank through an opening, which is also in a complicated shape.

Furthermore, when the imaginary complicated polygonal shape needs to be formed to accommodate the fuel components, the shape of the opening of the fuel tank may be in a complicated polygonal shape similarly to the module case. Accordingly, it is difficult to seal between the lid member and the fuel tank to maintain air tightness therebetween.

In the above embodiments, the imaginary circle is the perfect circle and the ellipse, which have smooth and simple circumferential periphery. Therefore, the module case can be easily inserted into the fuel tank through the opening, and the lid member and the fuel tank can be easily sealed therebetween.

(Variation)

In the above embodiments, the filter case 24 of the fuel filter 23 surrounds substantially throughout the periphery of the fuel pump 21. However, the filter case of the fuel filter may have a structure that surrounds a part of the outer periphery of the fuel pump 21. The fuel filter, which removes foreign matters contained in fuel discharged from the fuel pump 21, may not be accommodated in the fuel tank 1. That is, the fuel filter may not be included in the pump module accommodated in the fuel tank 1.

The components of the fuel feed system included in the pump module are not limited to the pressure regulator 60 and the level meter 64. Any components included in the pump module may be another component (fuel component) of the fuel feed system. The number of the components of the fuel feed system is not limited to be greater than one. The number of the components of the fuel feed system may be one.

The connecting portion, which connects the shaft 30 with the case (module case) of the pump module, may be a component separated from the module case.

In the above embodiments of the fuel feed apparatus, the pump module is directly accommodated in the fuel tank 1, and the pump module directly draws fuel in the fuel tank 1. However, the pump module may be accommodated in a sub-tank, and the pump module may draw fuel in the sub-tank in the structure, in which the flange and the module case respectively connect with the shaft, which is the supporting member, and the flange supports the pump module via the shaft.

The structures and methods of the above embodiments can be combined as appropriate.

Various modifications and alternations may be diversely made to the above embodiments without departing from the spirit of the present invention.

What is claimed is:

1. A fuel feed apparatus that supplies fuel in a fuel tank to an outside of the fuel tank, the fuel feed apparatus comprising:

a lid member that is mounted to the fuel tank, the lid member covering an opening of the fuel tank;

a fuel pump that is accommodated in the fuel tank, the fuel pump pumping fuel in the fuel tank;

a module case that supports the fuel pump;

a pump module that includes at least one fuel component protruding from a lateral side of the module case as a projection, which is viewed from a side of the lid member; and a supporting member that is connected with the lid member and the module case, wherein the supporting member supports the pump module in the fuel tank, the lid member supports the pump module via the supporting member, and the module case includes a connecting portion that connects with the supporting member, wherein the connecting portion protrudes from an outer periphery of the module case radially outwardly to a lateral side of the module case, the connecting portion is accommodated in an imaginary circle that passes through both an outer periphery of the module case and an outer periphery of the at least one protruding fuel component, and the imaginary circle accommodates therein the module case and the at least one protruding fuel component.

2. The fuel feed apparatus according to claim 1, wherein the pump module further includes a fuel filter that removes debris contained in fuel discharged from the fuel pump, and the module case accommodates a filter element of the fuel filter as a filter case.

3. The fuel feed apparatus according to claim 1, wherein the filter case surrounds substantially throughout the outer periphery of the fuel pump.

4. The fuel feed apparatus according to claim 1, wherein the at least one fuel component includes a level meter.

5. The fuel feed apparatus according to claim 1, wherein the at least one fuel component includes a pressure regulator.

6. The fuel feed apparatus according to claim 1, wherein the at least one fuel component includes a plurality of fuel components, the fuel pump has a center axis, through which an imaginary straight line passes in the projection, the projection is divided by the imaginary straight line into two regions, the plurality of components of the fuel system are arranged in one of the two regions in the projection, and the plurality of components of the fuel system are arranged to be in the vicinity of each other in the one of the two regions in the projection.

7. The fuel feed apparatus according to claim 1, further comprising:

a vibration insulator that is made of an elastic material, wherein the vibration insulator is arranged between the connecting portion and the supporting member.

8. The fuel feed apparatus according to claim 6, wherein the imaginary circle is a substantially perfect circle.

9. The fuel feed apparatus according to claim 1, wherein the at least one fuel component includes a plurality of fuel components, and at least one of the plurality of fuel components is arranged on a substantially opposite side of at least one other of the plurality of fuel components with respect to the module case in a radial direction of the module case.

10. The fuel feed apparatus according to claim 9, wherein the imaginary circle is an ellipse.

11. The fuel feed apparatus according to claim 1, wherein the module case is directly accommodated in the fuel tank.

12. The fuel feed apparatus according to claim 1, wherein the module case is adapted to make contact with a bottom surface of the fuel tank.

13. The fuel feed apparatus according to claim 1, wherein the connecting portion protrudes radially outwardly beyond a circumscribed circle of the outer periphery of the module case.

14. A fuel feed apparatus that supplies fuel in a fuel tank to an outside of the fuel tank, the fuel feed apparatus comprising:

a lid member that is mounted to the fuel tank, the lid member covering an opening of the fuel tank;

a fuel pump that is accommodated in the fuel tank, the fuel pump pumping fuel in the fuel tank;

a module case that supports the fuel pump;

a pump module that includes at least one fuel component protruding from a lateral side of the module case as a projection, which is viewed from a side of the lid member; and a supporting member that is connected with the lid member and the module case, wherein the supporting member supports the pump module in the fuel tank, he lid member supports the pump module via the supporting member, the module case includes a connecting portion that connects with the supporting member, the connecting portion protrudes from an outer periphery of the module case radially outwardly to a lateral side of the module case beyond a circumscribed circle of the outer periphery of the module case, the connecting portion is accommodated within an imaginary circle that passes through both an outer periphery of the module case and an outer periphery of the at least one protruding fuel component, and the imaginary circle accommodates therein the module case and the at least one protruding fuel component.

15. A fuel feed apparatus for pumping fuel from a fuel tank, the fuel feed apparatus comprising:

a lid member for covering an opening of the fuel tank;

a fuel pump that is accommodated in the fuel tank for pumping fuel;

a module case that supports the fuel pump;

a pump module that includes at least one fuel component protruding radially outwardly from an outer periphery of the module case; and a supporting member that connects the lid member with the module case for supporting the pump module in the fuel tank, wherein the module case includes a connecting portion that connects the module case with the supporting member, the outer periphery of the module case defines a first circumscribed circle when being viewed from the lid member, the connecting portion protrudes from the outer periphery of the module case radially outwardly beyond the first circumscribed circle, the outer periphery of the module case and an outer periphery of the at least one protruding fuel component define a second circumscribed circle when being viewed from the lid member, the second circumscribed circle accommodates the connecting portion therein when being viewed from the lid member.

* * * * *